US010410457B2

(12) United States Patent
Al Refae

(10) Patent No.: US 10,410,457 B2
(45) Date of Patent: Sep. 10, 2019

(54) MEDIA DISPENSER CASSETTE MECHANISM (MDCM)

(71) Applicant: Badr M. Al Refae, Chennai (IN)

(72) Inventor: Badr M. Al Refae, Chennai (IN)

( * ) Notice: Subject to any disclaimer, the term of this patent is extended or adjusted under 35 U.S.C. 154(b) by 114 days.

(21) Appl. No.: 15/526,572

(22) PCT Filed: Nov. 16, 2015

(86) PCT No.: PCT/IN2015/000425
§ 371 (c)(1),
(2) Date: May 12, 2017

(87) PCT Pub. No.: WO2016/079754
PCT Pub. Date: May 26, 2016

(65) Prior Publication Data

US 2018/0315269 A1 Nov. 1, 2018

(30) Foreign Application Priority Data

Nov. 19, 2014 (IN) ..... 5806/CHE/2014

(51) Int. Cl.
*B65H 3/44* (2006.01)
*G07D 11/00* (2019.01)
(Continued)

(52) U.S. Cl.
CPC ..... *G07D 11/13* (2019.01); *B65H 3/32* (2013.01); *B65H 3/44* (2013.01); *B65H 29/20* (2013.01);
(Continued)

(58) Field of Classification Search
CPC .. B65H 2701/1912; B65H 7/12; B65H 7/125; B65H 2405/332; B65H 3/44; B65H 5/26;
(Continued)

(56) References Cited

U.S. PATENT DOCUMENTS 5,405,131 A 4/1995 Zouzoulas
7,533,800 B2 5/2009 Tripp et al.
(Continued)

FOREIGN PATENT DOCUMENTS

CN 1892709 A 1/2007
CN 102779368 A 11/2012
WO 2009049372 A1 4/2009

OTHER PUBLICATIONS

International Search Report & Written Opinion dated May 10, 2016 from corresponding International PCT Application No. PCT/IN2015/000425, 8 pages.

*Primary Examiner* — Luis A Gonzalez
(74) *Attorney, Agent, or Firm* — Innovation Capital Law Group, LLP; Vic Lin

(57) ABSTRACT

A compact and cost effective Media Dispenser Cassette Mechanism (MDCM) in the ATMs, which functions as a complete cash and media dispenser on its own. Each Media Dispenser Cassette (MDC) comprises a cover head assembly (101), a main frame assembly (102), a bottom cover assembly (103) and a top cover assembly (104). The main frame assembly (102) comprises a main path roller assembly (301), a motor assembly (302), a picker assembly (303), a shaft driver assembly (304), a Printed Circuit Board (PCB) mounting plate assembly (305), a note pick assembly (306), an idler assembly (307), a roller assembly (316), and a main transport and a roller assembly (320). The MDC independently controls transporting and delivers note by note which is collected by bunch of cash presenter and then delivered to the user as a bunch of cash thereby shortening the note travel, eliminating jam conditions and note rejections.

4 Claims, 7 Drawing Sheets

Figure 1:
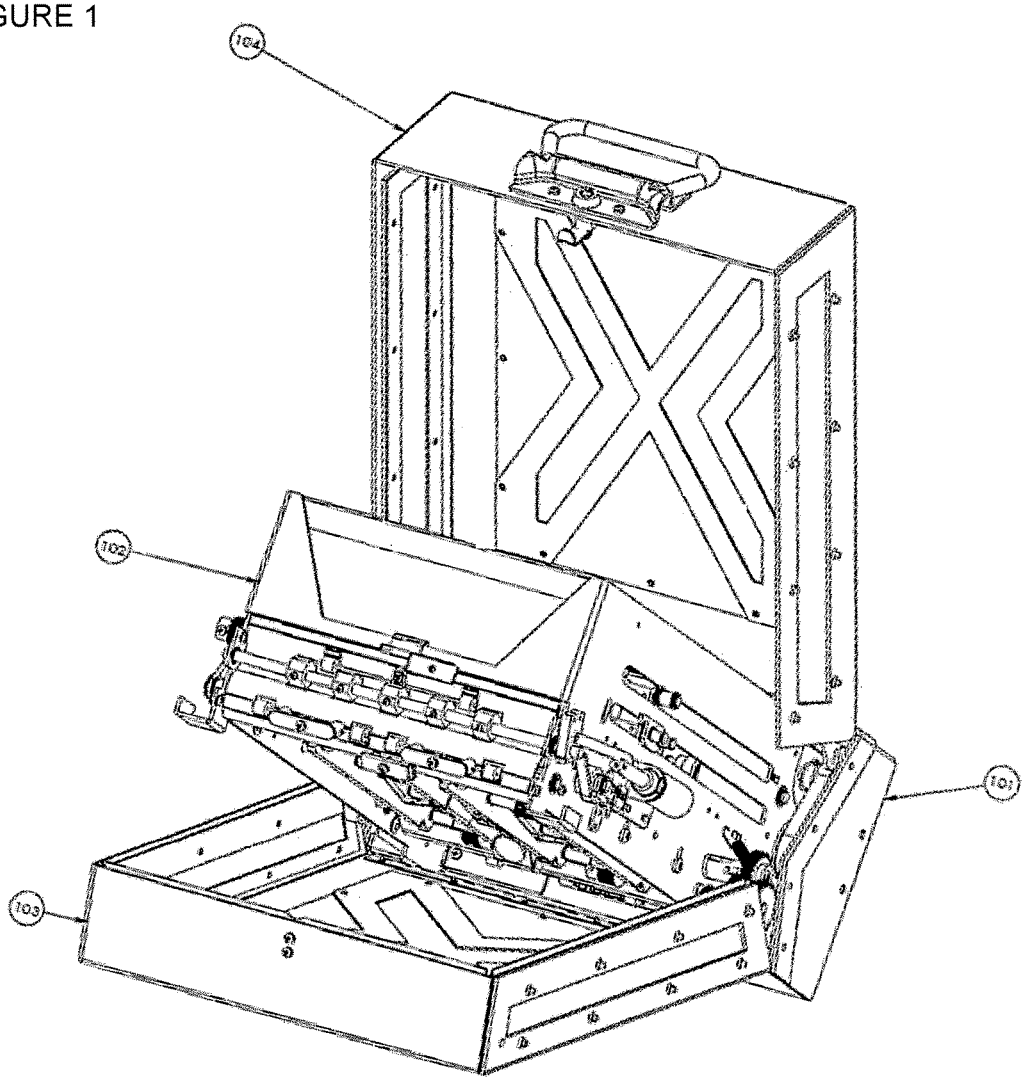

(51) Int. Cl.

| | |
|---|---|
| ***G07D 11/13*** | (2019.01) |
| ***G07D 11/125*** | (2019.01) |
| ***G07F 19/00*** | (2006.01) |
| ***B65H 3/32*** | (2006.01) |
| ***B65H 29/20*** | (2006.01) |
| ***B65H 29/58*** | (2006.01) |
| ***B65H 43/00*** | (2006.01) |

(52) U.S. Cl.
CPC ..... *B65H 29/58* (2013.01); *B65H 43/00* (2013.01); *G07D 11/125* (2019.01); *G07F 19/203* (2013.01); *G07F 19/205* (2013.01); *B65H 2402/41* (2013.01); *B65H 2405/11* (2013.01); *B65H 2405/332* (2013.01); *B65H 2408/13* (2013.01); *B65H 2701/1912* (2013.01)

(58) Field of Classification Search
CPC ..... G07D 11/0006; G07D 11/0009; G07D 11/0012; G07D 11/0021; G07D 11/0039; G07D 11/0081; G07F 19/20; G07F 19/203; G07F 19/205
See application file for complete search history.

(56) References Cited

U.S. PATENT DOCUMENTS

| | | | | |
|---|---|---|---|---|
| 7,886,888 | B1 | 2/2011 | Chien et al. | |
| 8,052,044 | B2 | 11/2011 | Washington et al. | |
| 2007/0001378 | A1* | 1/2007 | Jantsch | B65H 5/00 271/145 |
| 2008/0007146 | A1* | 1/2008 | Hillman | G07D 11/0009 312/183 |
| 2010/0188219 | A1 | 7/2010 | Todd | |
| 2012/0255829 | A1* | 10/2012 | Togiya | B65H 1/266 194/206 |
| 2018/0165907 | A1* | 6/2018 | Yang | G07F 19/00 |

* cited by examiner

MEDIA DISPENSER CASSETTE MECHANISM (MDCM)

FIELD OF INVENTION

The present invention relates to the field of Banking and Automated teller machines (ATMs) and particularly, relates to cash and media dispenser mechanism. More particularly, the present invention relates to a compact and cost effective Media Dispenser Cassette Mechanism (MDCM) in the ATMs, which functions as a complete cash and media dispenser on its own. The Media Dispenser Cassette (MDC) of the present invention controls transport and delivery of notes without the cash and media having to travel through a separate transport mechanism to reach the cash presenter or mechanical delivery arm thereby shortening the note travel, eliminating jam conditions and note rejections. Advantageously, the MDC of the present invention does not affect the functioning of other MDC's in dispensing of cash and media when there is any electromechanical failure in a particular MDC.

DESCRIPTION OF PRIOR ART

ATM is an electronic telecommunication device that enables the customers of a financial institution such as a bank to perform financial transactions without the need for a human cashier, clerk or bank teller. The ATMs or cash dispensing machines generally use containers or currency cassette modules in which stacks of currency notes are stored. One cassette module holds a stack of one denomination of currency. When the cassette module is installed in the ATM, its dispensing end is positioned therein to enable a picker mechanism in the ATM to pick the front sheet or bill from the stack of bills in the cassette as part of a cash dispensing operation.

In the existing ATM, the cash dispenser unit comprises of multiple currency cassettes, note picker module(s), twin note detection module(s), common currency notes transport module, common currency notes stacking module, currency presenter and common currency notes reject module, wherein said devices and modules are controlled by a single electronic control board.

If there is any electronic failure in the electronic control board or any mechanical failure in the transport module or in the stacker module, the entire cash dispensing unit cannot function to dispense cash.

Some of the prior arts are:

U.S. Pat. No. 7,533,800 discloses a transport system for valuable items comprising a portable container for carrying one or more valuable items therein and an enclosure arranged to receive the portable container. The portable container includes a transponder and the enclosure includes a transponder detector arranged to detect the presence of the transponder included in the portable container. A radio frequency identity tag (RFID) is fitted to the inside of each cassette wall close to the front or handle end of the cassette.

U.S. Pat. No. 8,052,044 discloses an ATM currency cassette which includes an RFID tag. The tag includes information about the cassette, such as the cassette serial number and the currency denomination. An ATM includes a tag reader that can interrogate the tag to receive the information. The history of a particular cassette can be tracked via the cassette serial number. Problem cassettes can be identified. Furthermore, codes or IDs entered into a keypad can be recorded e.g., stored in a memory by the electronic lock. Dates and times of access or attempted access can also be recorded. Thus, an audit trail of cassette access can be recorded.

US20100188219 discloses a security module that comprises a motion detector, a microcontroller and an antenna. The motion detector detects motion of the security module relative to a cellular telephone network. The security module is adapted to be installed into the cash cassette of an Automatic Telling Machine (ATM) or any container in which valuable goods are stored. A tracking module comprises a microcontroller and an antenna for receiving and transmitting radio frequency signals. The tracking module enables a user to home in on the security module via an exchange of radio frequency-signals.

WO2009049372 discloses a cash storage cassette that comprises a security pack of a modular structure. The security pack comprises a container module arranged to, upon receiving a trigger signal, release a theft deterrent substance. The pack also comprises an electronic circuitry module arranged to send the trigger signal to the container module for releasing the theft deterrent substance, when a predetermined condition is satisfied. The electronic circuitry module and the container module are connected by a flexible wire connection.

Thus, there exists a need for a self serving cassette module for use in the ATM, which controls the dispensing and the transport of currency notes in cassette directly to the customer without the currency notes having to travel through a separate transport mechanism to reach the currency presenter or mechanical delivery arm to deliver currency to the customer.

OBJECTS OF INVENTION

One or more of the problems of the conventional prior art may be overcome by various embodiments of the system and method of the present invention.

Accordingly, it is the primary object of the present invention to provide a compact and cost effective Media Dispenser Cassette Mechanism (MDCM) for use in the ATMs, which functions as complete cash and media dispenser on its own.

It is another object of the present invention to provide MDCM in the ATMs, which controls transport and delivery of cash/notes without the cash and media having to travel through a separate transport mechanism to reach the cash presenter or mechanical delivery arm.

It is another object of the present invention to provide a suitable note delivery system within a Media Dispenser Cassette (MDC) to deliver cash to the customer.

It is another object of the present invention to provide one or more MDCs in the ATMs, which does not affect the functioning of other MDCs in dispensing of cash and media when there is any electromechanical failure in the particular MDC.

It is another object of the present invention, wherein each of the MDC functions independently of one another in dispensing the cash and media.

It is another object of the present invention, wherein the MDC independently controls transporting and delivers note by note which is collected by bunch of cash presenter and then delivered to the user as a bunch of cash thereby shortening the note travel, eliminating jam conditions and note rejections.

SUMMARY OF INVENTION

Thus according to the basic aspect of the present invention there is provided a Media Dispenser Cassette Mechanism (MDCM) in an Automated teller machine (ATM), wherein each Media Dispenser Cassette (MDC) comprising of:

cover head assembly;

main frame assembly;

bottom cover assembly; and top cover assembly, wherein the main frame assembly further comprising of main path roller assembly; motor assembly; picker assembly; shaft driver assembly; Printed Circuit Board (PCB) mounting plate assembly; note pick assembly; idler assembly; roller assembly; and main transport and roller assembly, wherein one or more MDCs are stacked on top of each other in a security container, said security container comprising of door assembly with note delivery system; and one or more mounting brackets, wherein note delivery mechanism positioned within the door assembly with note delivery system includes sensor assembly, said sensor assembly senses notes to be picked by the note pick assembly and delivered, wherein if the notes are single and not overlapped, said notes are picked and go through transport mechanism of the main transport and roller assembly, wherein if the sensor assembly detects more than one note, the same are rejected by picker rejection side mechanism of the main path roller assembly and diverted and stored inside the MDC, wherein electronic control board positioned in the PCB mounting plate assembly inside the MDC releases lock to unlock said MDC to function as complete cash and media dispenser on its own, and wherein the MDC independently controls transporting and delivers note by note which is collected by bunch of cash presenter and then delivered to the user as a bunch of cash thereby shortening the note travel, eliminating jam conditions and note rejections.

It is another aspect of the present invention, wherein the sensor assembly positioned inside the MDC is ultrasonic acoustic based.

It is another aspect of the present invention, wherein each of the MDC functions independently of one another in dispensing the cash and media.

It is another aspect of the present invention, wherein audit record on functioning of each MDC is stored inside the individual MDC.

BRIEF DESCRIPTION OF THE ACCOMPANYING DRAWINGS

FIG. 1: illustrates open position view of the whole Media Dispenser Cassette (MDC) containing the complete dispenser mechanism according to the present invention.

Figure 2:
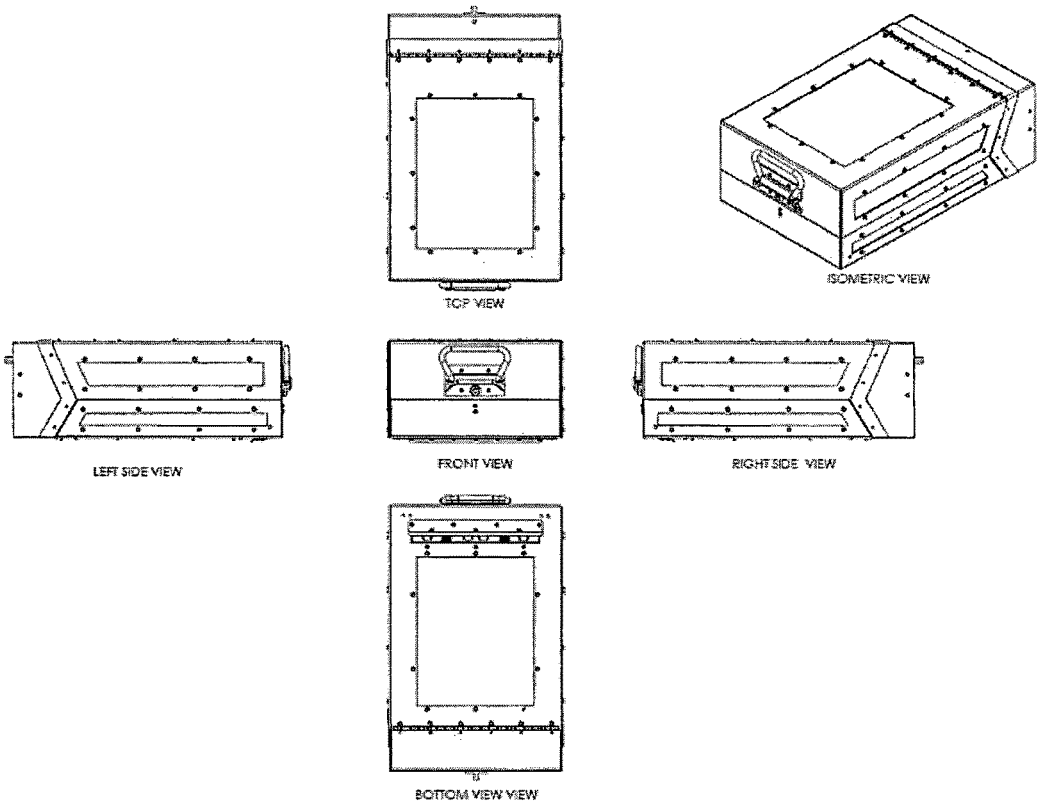

FIG. 2: illustrates isometric, top, bottom, front, right side and left side views of the whole MDC in a closed position according to the present invention.

Figure 3:
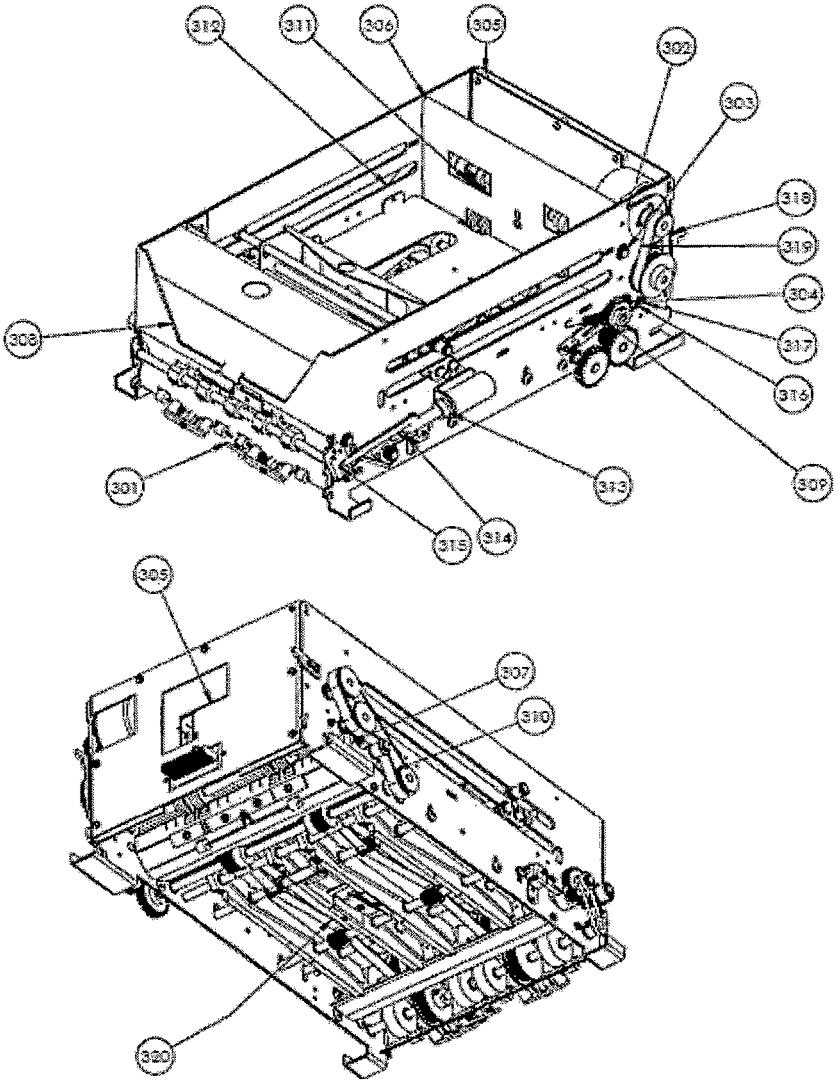

FIG. 3: illustrates exploded and bottom view of the main frame assembly as in FIG. 1 according to the present invention.

Figure 4:
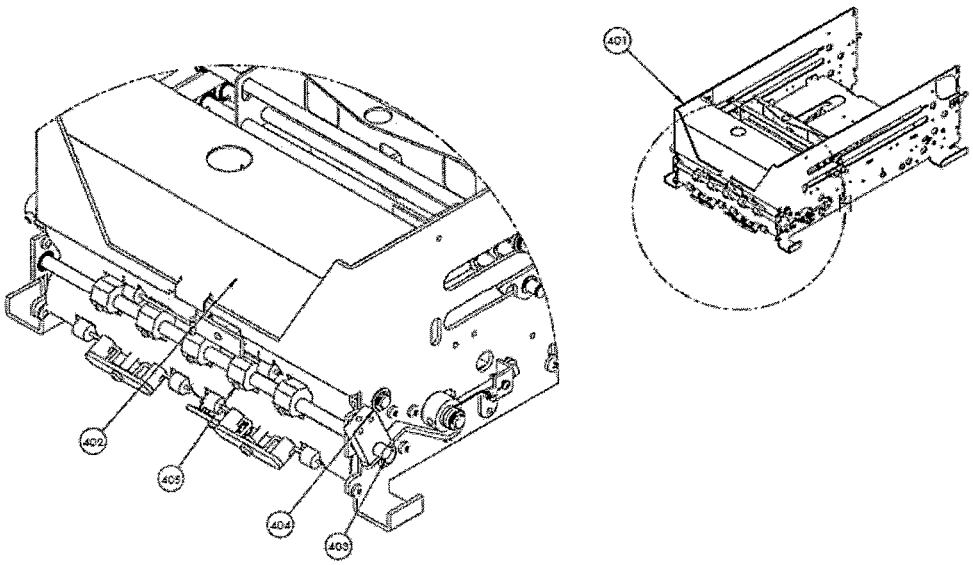

FIG. 4: illustrates an exploded view of the main path roller assembly as in FIG. 3 according to the present invention.

Figure 5:
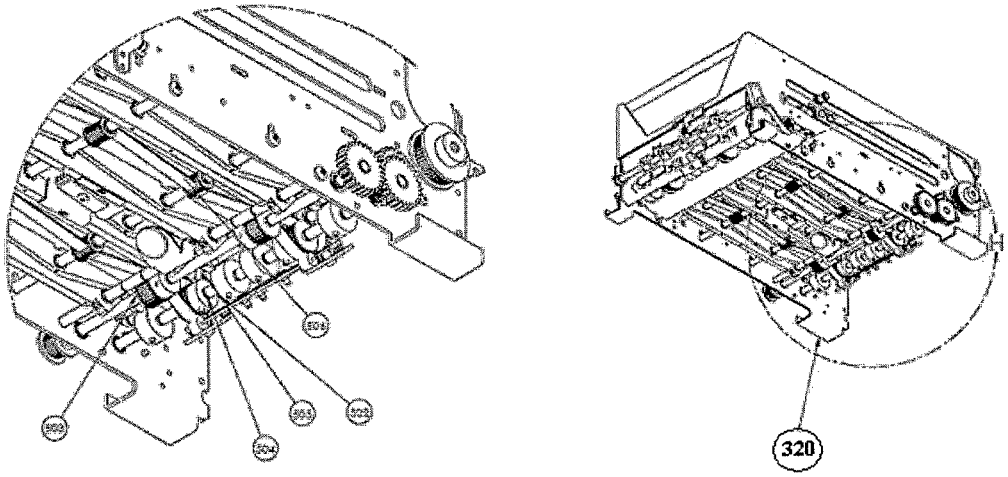

FIG. 5: illustrates exploded view of the main transport and roller assembly as in FIG. 3 according to the present invention.

Figure 6:
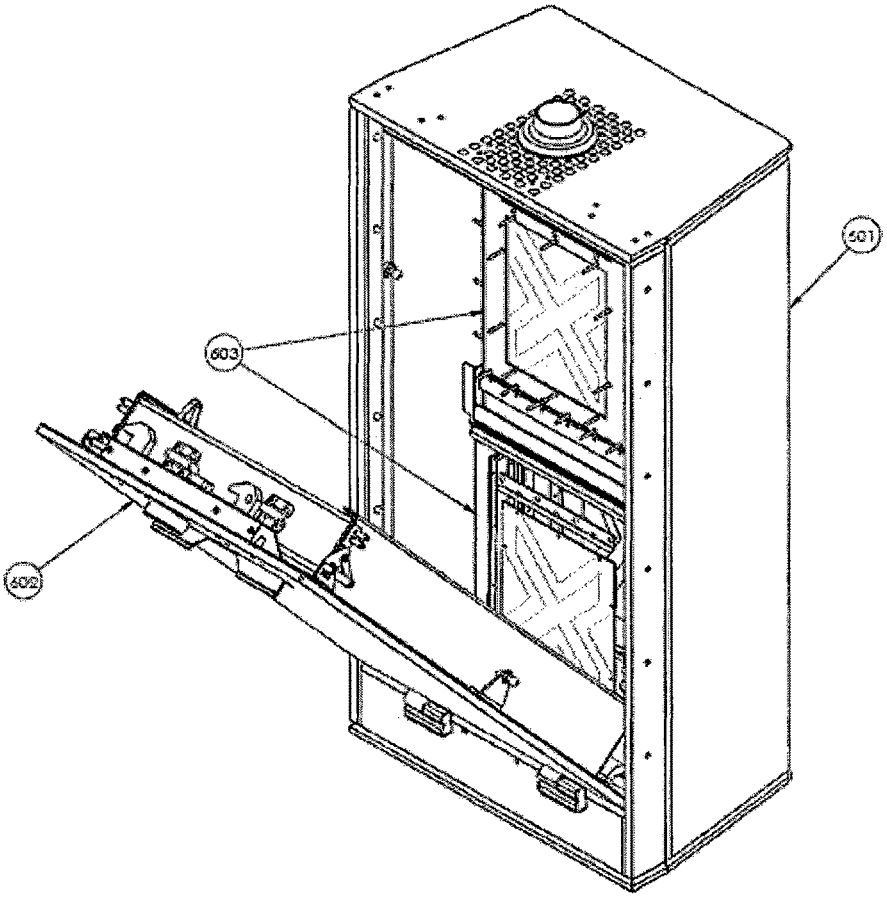

FIG. 6: illustrates exploded view of stacking arrangements of one or more MDC's inside a security container according to the present invention.

Figure 7:
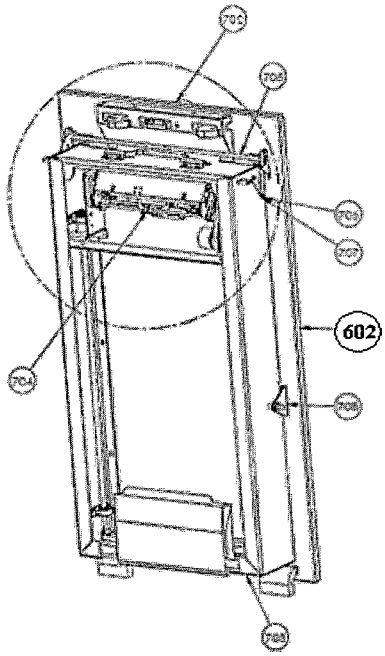

FIG. 7: illustrates exploded view of the door assembly with note delivery system as in FIG. 6 mounted on a security door assembly inside a security container according to the present invention.

Figure 8:
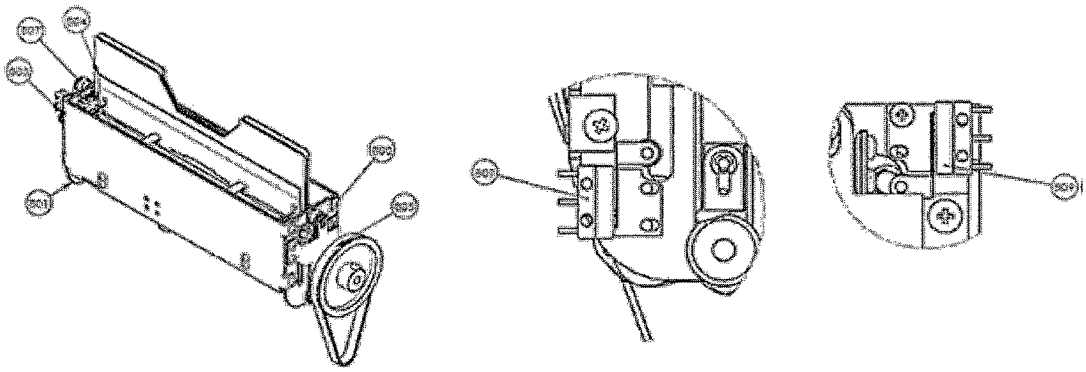

FIG. 8: illustrates exploded view of the note delivery mechanism as in FIG. 7 in the travel position according to the present invention.

Figure 9A:
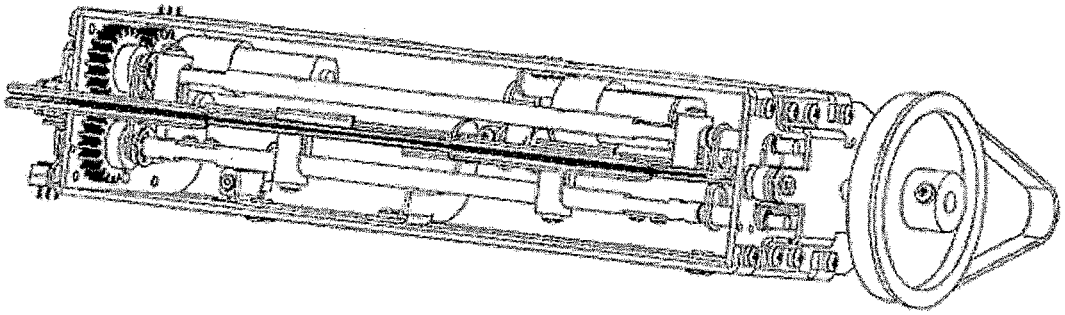
Figure 9B:
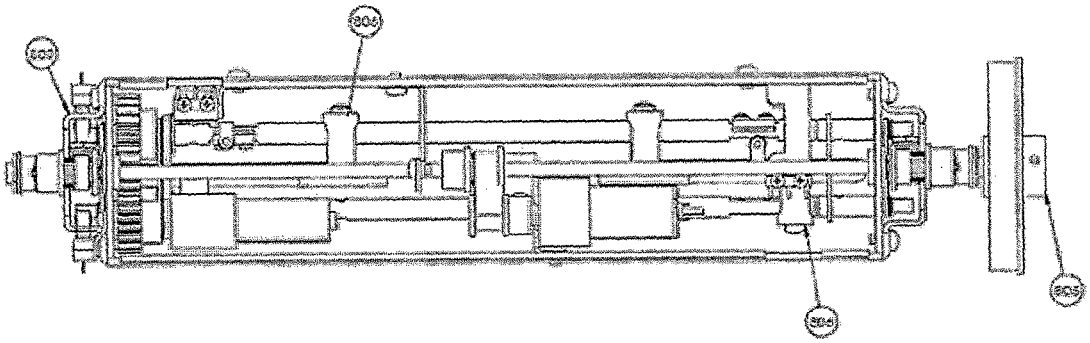

FIGS. 9*a* and 9*b*: illustrate the note delivery mechanism as in FIG. 8 in pick and present positions according to the present invention.

DETAILED DESCRIPTION OF THE INVENTION WITH REFERENCE TO THE ACCOMPANYING FIGURES

The present invention is thus directed to a compact and cost effective Media Dispenser Cassette Mechanism (MDCM) in the ATMs, which functions as a complete cash and media dispenser on its own. The Media Dispenser Cassette (MDC) of present invention controls transport and delivery of cash/notes without the cash and media having to travel through a separate transport mechanism to reach the cash presenter or mechanical delivery arm thereby shortening the note travel, eliminating jam conditions and note rejections.

Referring to FIGS. 1 to 9, each of the MDC comprises of cover head assembly [101]; main frame assembly [102]; bottom cover assembly [103]; and top cover assembly [104]. The main frame assembly [102] as shown in FIG. 3 further comprising of main path roller assembly [301]; motor assembly [302]; picker assembly [303]; shaft driver assembly [304]; Printed Circuit Board (PCB) mounting plate assembly [305]; note pick assembly [306]; idler assembly [307]; stipener gear [308]; at least two retards/plates [309 and 310]; at least two belts [311 and 312]; solenoid assembly [313]; solenoid rod pin [314]; solenoid guide [315]; roller assembly [316]; at least two fasteners [317 and 318]; motor belt [319] and main transport and roller assembly [320].

Referring to FIG. 4 which illustrates an exploded view of the main path roller assembly as in FIG. 3, the main path roller assembly [301] comprising of main path frame assembly [401]; one or more pulley assemblies [402 and 403]; picker rejection side [404]; and diverter assembly [405].

Referring to FIG. 5 which illustrates exploded view of the main transport and roller assembly as in FIG. 3, the main transport and roller assembly [320] comprising of retard assembly [502]; pulley assembly [503]; note path assembly [504]; picker adjuster [505]; and belt [506].

The MDC's are stacked in a security container [601] as shown in FIG. 6, said security container [601] comprising of door assembly with note delivery system [602] and at least two mounting brackets [603] for at least two MDC's that are stacked on top of each other to provide a more compact and space saving design.

The door assembly with note delivery system [602] as shown in FIG. 7 comprising of sliding handle [702]; cover plate [703]; note delivery mechanism [704]; shaft hook assembly [705]; side swing hook plate [706]; side swing hook in [707]; and plate pivot assembly [708].

The note delivery mechanism [704] as shown in FIGS. 8, 9*a* and 9*b* in the travel position comprising of sensor assembly [801]; at least two disk holder assemblies [802 and 803]; paper/tickets [804]; belt [805, 807 and 808]; main clipper note assembly [806]; and mechanical sensor assembly [809].

The sensor assembly [801] that includes but not limited to ultrasonic acoustic based double note detect sensor is positioned inside the MDC, said ultrasonic acoustic based sensor assembly [801] senses the notes to be picked by the note pick assembly [306] and delivered. If the notes are single and not overlapped, said notes are picked and go through transport mechanism of the main transport and roller assembly [320]. If the sensor assembly [801] detects more than one note, the same are rejected by the picker rejection side mechanism [404] of the main path roller assembly [301]; and diverted and stored inside the MDC. The cash reconciliation is much easier and produces an accurate account of the cash inventory inside the MDC.

The electronic control board positioned in the PCB mounting plate assembly [305] inside the MDC releases lock to unlock said MDC to function as complete cash and media dispenser on its own. Audit record on functioning of each MDC is stored inside the individual MDC. The MDC does not affect the functioning of other MDCs in dispensing cash and media when there is any electromechanical failure in the particular MDC. The MDC thus independently controls transporting and delivers note by note which is collected by bunch of cash presenter and then delivered to the user as a bunch of cash thereby, shortening the note travel, eliminating jam conditions and note rejections.

Advantages of the present invention are as follows:

Compact and cost effective mechanism.

Since each MDC has its own transport module: the currency jam conditions are greatly minimized and reduced compared to traditional mechanism; the MDC operates efficiently and can deal with bad notes much better than traditional and current art cash and media dispenser mechanism.

All the required components and modules to dispense the cash and reject are securely placed inside the MDC thereby shortening the note travel, almost eliminating the jam conditions and double note rejections improves handling of less fit notes conditions.

The cash inside the MDC is always secured and does not get exposed during the dispensing operation.

MDC delivers note by note which is collected by the bunch of cash presenter and then delivered to the customer as a bunch of cash.

The MDC uses ultrasonic acoustic based double note detector which is extremely accurate, maintenance free and not susceptible to dust and other environmental conditions.

Any electromechanical failure in a particular MDCM will not affect the functioning of other MDC's in dispensing cash.

In place of faulty MDC, a replacement MDC can be swapped. Hence the dispenser downtime is minimized to a greater extent.

I claim:

1. A Media Dispenser Cassette Mechanism (MDCM) in a security container, wherein a Media Dispenser Cassette (MDC) comprises:

a cover head assembly [101];

a main frame assembly [102];

a bottom cover assembly [103]; and a top cover assembly [104], wherein the main frame assembly [102] further comprises a main path roller assembly [301]; a motor assembly [302]; a picker assembly [303]; a shaft driver assembly [304]; a Printed Circuit Board (PCB) mounting plate assembly [305]; a note pick assembly [306]; an idler assembly [307]; a roller assembly [316]; and a main transport and roller assembly [320], wherein multiple MDCs are stacked on top of each other in the security container [601], said security container [601] comprising a door assembly with a note delivery system [602]; and one or more mounting brackets [603], wherein a note delivery mechanism [704] positioned within the door assembly with the note delivery system [602] includes a sensor assembly [801], said sensor assembly senses notes to be picked by the note pick assembly [306] and delivered, wherein if the notes are single and not overlapped, said notes are picked and go through the main transport and roller assembly [320], wherein if the sensor assembly [801] detects more than one note, the same are rejected by a picker rejection side mechanism [404] of the main path roller assembly [301] and diverted and stored inside the MDC, wherein the MDC is operable to unlock said MDC to function as a complete cash and media dispenser on its own, and wherein the MDC independently controls transporting and delivers note by note which is collected by the note delivery system and then delivered to the user as a bunch of cash thereby shortening the note travel, eliminating jam conditions and note rejections.

2. The Media Dispenser Cassette Mechanism (MDCM) as claimed in claim 1, wherein the sensor assembly [801] positioned inside the MDC is an ultrasonic acoustic based.

3. The Media Dispenser Cassette Mechanism (MDCM) as claimed in claim 1, wherein each of the MDC functions independently of one another in dispensing the cash and media.

4. The Media Dispenser Cassette Mechanism (MDCM) as claimed in claim 1, wherein an audit record on functioning of each MDC is stored inside the individual MDC.

* * * * *